US006457900B2

(12) United States Patent
Bond

(10) Patent No.: US 6,457,900 B2
(45) Date of Patent: Oct. 1, 2002

(54) SPEED SENSITIVE AUTOMATIC SPEED BUMP

(76) Inventor: Michael L. Bond, 3530 Harmony Cove, Lilburn, GA (US) 30047

( * ) Notice: Subject to any disclaimer, the term of this patent is extended or adjusted under 35 U.S.C. 154(b) by 0 days.

(21) Appl. No.: 09/874,916

(22) Filed: Jun. 5, 2001

Related U.S. Application Data

(63) Continuation-in-part of application No. 09/413,097, filed on Oct. 7, 1999, now Pat. No. 6,241,419.

(60) Provisional application No. 60/107,029, filed on Nov. 4, 1998, provisional application No. 60/118,079, filed on Jan. 29, 1999, provisional application No. 60/126,466, filed on Mar. 26, 1999, and provisional application No. 60/126,912, filed on Mar. 29, 1999.

(51) Int. Cl.[7] ..... E01F 11/00

(52) U.S. Cl. ..... 404/15

(58) Field of Search ..... 404/6, 10, 15, 404/9

(56) References Cited

U.S. PATENT DOCUMENTS

| | | | | | |
|---|---|---|---|---|---|
| 1,624,900 | A | * | 4/1927 | Parkhurst | 404/6 |
| 1,649,877 | A | * | 11/1927 | Walston | 404/6 |
| 1,776,447 | A | * | 9/1930 | Parkhurst | 404/6 |
| 3,389,677 | A | * | 6/1968 | Dunne | 404/15 |
| 4,342,525 | A | * | 8/1982 | Mastronuzzi, Jr. | 404/6 |
| 4,367,975 | A | * | 1/1983 | Tyers | 404/6 |
| 4,974,991 | A | * | 12/1990 | Mandavi | 404/6 |
| 5,267,808 | A | | 12/1993 | Welford | |
| 5,486,065 | A | * | 1/1996 | James | 404/15 |
| 5,509,753 | A | * | 4/1996 | Thompson | 404/6 |
| 6,010,277 | A | * | 1/2000 | Follman | 404/11 |
| 6,024,510 | A | * | 2/2000 | Kamienchick | 404/15 |
| 6,174,103 | B1 | | 1/2001 | Stroman | |

FOREIGN PATENT DOCUMENTS

| | | | |
|---|---|---|---|
| EP | 0 664 361 | * | 1/1995 |
| GB | 2 333 114 | * | 7/1999 |

* cited by examiner

*Primary Examiner*—Gary S. Hartmann
(74) *Attorney, Agent, or Firm*—Gardner Groff & Mehrman, P.C.

(57) ABSTRACT

An automatic speed sensitive speed bump having a base plate, a front plate hingedly connected to the base plate, and a spring that biases the front plate toward a raised position. A speed-sensitive lock mechanism for locking the front plate in the raised position when impacted by a vehicle tire traveling at a speed at or above a predetermined speed. However, when the vehicle is traveling below the predetermined speed, the front plate is not locked in the raised position and collapses to a horizontal position such that the vehicle does not experience a bump.

22 Claims, 16 Drawing Sheets

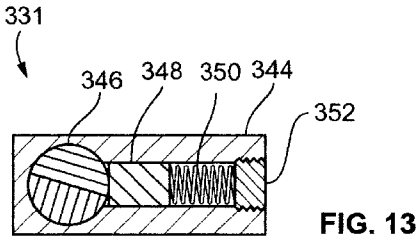
FIG. 13
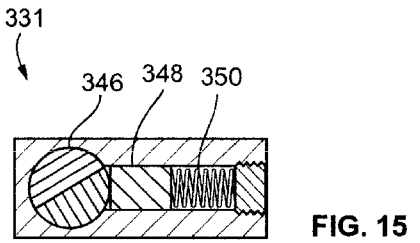
FIG. 15
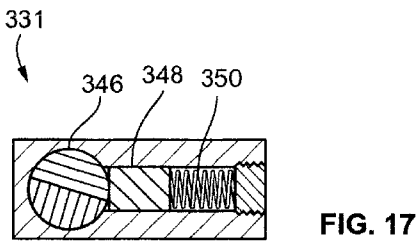
FIG. 17
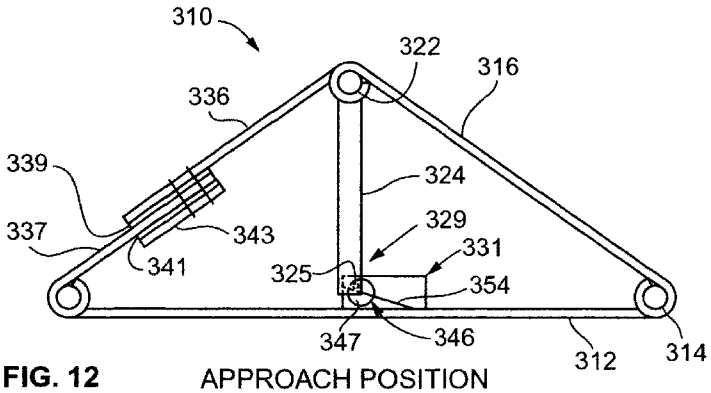
FIG. 12 APPROACH POSITION
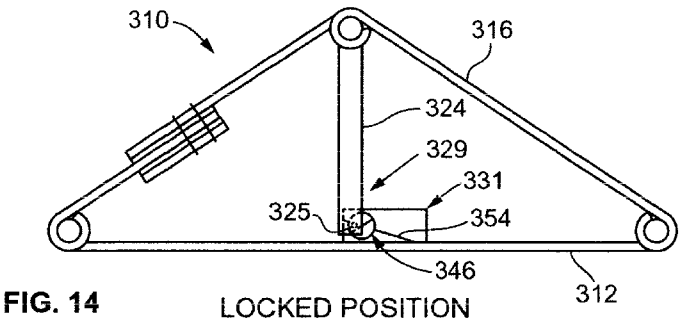
FIG. 14 LOCKED POSITION
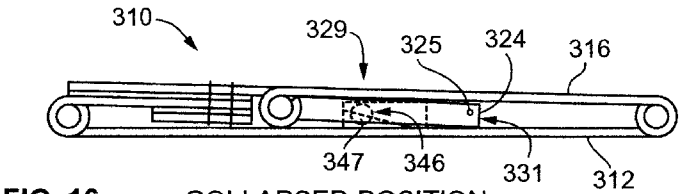
FIG. 16 COLLAPSED POSITION

SPEED SENSITIVE AUTOMATIC SPEED BUMP

CROSS-REFERENCE TO RELATED APPLICATIONS

This application is a continuation-in-part which claims the priority benefit of U.S. patent application Ser. No. 09/413,097, filed on Oct. 7, 1999, now U.S. Pat. No. 6,241,419, which claims the priority benefit of four (4) U.S. Provisional Applications, namely, Serial No. 60/107,029 filed on Nov. 4, 1998, Serial No. 60/118,079 filed on Jan. 29, 1999, Serial No. 60/126,466 filed on Mar. 26, 1999, and Serial No. 60/126,912 filed on Mar. 29, 1999, all of which are hereby incorporated by reference in their entirety.

FIELD OF THE INVENTION

The invention relates generally to mechanical devices installed on roadways to slow the speed of motor vehicles, and relates more particularly to an automatic speed bump that is operative based on the speed of the vehicle contacting the bump.

BACKGROUND OF THE INVENTION

In the interest of safety to other vehicles and nearby pedestrians, the speed of motorized vehicles should be kept to a safe level. Excessive vehicular speeds, especially on roads through residential areas and in parking lots, create a dangerous environment for drivers and pedestrians alike. To that end, speed limits are posted on roads, with the local speed limit being dependent on the type of road and the location of the road. Unfortunately, many drivers disregard the posted speed limit.

Other methods, which drivers cannot disregard, are employed on some roads to keep the speed of vehicles at a safe level. It is common for speed bumps to be placed across roads in neighborhoods, parking lots, and other areas where it is desirable to ensure that vehicle speeds are limited. Such speed bumps are usually elongate, mounded areas of asphalt or cement that traverse the width of the road, or the width of a driving area of a parking lot, to ensure that each vehicle encounters the speed bump. The speed bumps are usually painted or physically treated in some manner to alert drivers to the presence of the speed bumps. The dimensions of the speed bumps are such that a vehicle must be slowed to a low speed to pass over the speed bump without jarring the vehicle. Passing over a speed bump at a higher speed, as is known to most drivers, causes a very undesirable jolt to the vehicle and its occupants. In this manner, speed bumps cause drivers to slow down to a low speed to pass over the bump.

Speed bumps are typically installed at intermittent locations along a road or parking lot, but close enough to each other so that vehicles traveling between adjacent speed bumps do not have enough linear road space to accelerate to an unsafe speed, considering the low speed to which the vehicle is slowed to pass over the speed bumps. The speed bumps can be spaced apart any desired distance, which usually depends on the type, shape, and location of the road. For example, speed bumps in a parking lot should be placed relatively close together to drastically limit the speed of vehicles to perhaps 10 mph, but speed bumps on a residential street can be placed further apart to limit the speed of vehicles to perhaps 20 mph or 30 mph. Therefore, speed bumps prevent vehicles from traveling at unsafe speeds along an expanse of a road, in a parking lot, or other driving area.

However, such speed bumps can be very inconvenient and frustrating because they do not discriminate between vehicles driving at different speeds. Speed bumps are installed to require drivers traveling too fast to slow to a low speed to pass over the speed bump. However, drivers that already are traveling at a safe speed do not need the added deterrent of the speed bump to maintain their vehicles at a safe speed. Therefore, although a speed bump is necessary to slow down a fast driver, the speed bump is not necessary, and is a nuisance, for the slower, safer driver who does not exceed the speed limit.

Therefore, speed bumps indiscriminately affect all drivers, even those traveling at a safe speed. This indiscriminate effect on vehicles traveling over speed bumps has caused many people to be opposed to the installation of speed bumps where they are otherwise needed, thereby contributing to an unsafe environment for other drivers on the road and nearby pedestrians.

Therefore, it can be seen that there is a need in the art for an automatic speed bump that is operative based on the speed of the vehicle that contacts the speed bump. There is also a need for an automatic speed bump that provides a bump for vehicles that encounter the speed bump traveling over a predetermined speed, but does not provide a bump for vehicles traveling below the predetermined speed. It is to the provision of such a speed bump that the present invention is primarily directed.

SUMMARY OF THE INVENTION

Briefly described, the present invention comprises a speed bump mounted on top of the pavement or recessed into the pavement. A front pivot member is hingedly connected to a base. The front pivot member is biased upwardly such that it is maintained at an inclined position in the absence of an external force acting upon it. The speed bump further comprises a speed-sensitive lock mechanism for locking the front pivot member in a raised position.

When a vehicle engages the speed bump at a speed that exceeds a predetermined speed, the impact of the tires on the speed bump causes the speed-sensitive lock mechanism to restrain the front pivot member in an inclined position. The inclined front pivot member thus provides a bump to a vehicle traveling above the predetermined speed. However, when the vehicle is traveling at a speed below the predetermined speed, the impact of the tires on the speed bump does not cause the speed-sensitive lock mechanism to restrain the front pivot member in an inclined position. Instead, the front pivot member collapses to a horizontal position such that the vehicle does not experience a bump.

Stated another way, in a preferred form the present invention comprises an automatic speed bump for use on a driving surface. The speed bump includes a base element mounted or recessed into the driving surface. A front pivot member is hingedly connected to the base plate and is biased towards an inclined, raised position by a spring. A speed-sensitive lock mechanism locks the front pivot member in a raised position when impacted by a vehicle tire traveling at a speed at or above the selected speed.

In a preferred form, the speed-sensitive lock mechanism comprises a lock member hingedly connected to the upper end of the front pivot member. The lock member has a lower end which rotates about the hinged connection. The lower end of the lock member is urged upwardly by a biasing means.

When a vehicle engages the speed bump at a speed that exceeds a predetermined speed, the impact of the tires on the speed bump causes the lock member to be driven downwardly rapidly enough, and with enough force, to force the lower end of the lock member into contact with the upper surface of the base plate. The lower end of the lock member is then restrained by the friction force between the lock member lower end and the upper surface of the base plate. This friction prevents any further rearward movement of the lock member, and therefore locks the front pivot member of the speed bump in an inclined position, thus providing a bump to the vehicle traveling above the predetermined speed.

However, when the vehicle is traveling at or below the predetermined speed, the force on the front pivot member causes the lock member to be driven downwardly to a lesser degree and more slowly as the lock member moves toward the base plate. The lower end of the lock member is not driven down hard enough to be restrained by the upper surface of the base plate. Instead, the biasing means urges the lower end of the lock member above the base plate. The lock member then slides along the top surface of the base plate. In this manner, the front pivot and lock members collapse to a horizontal position such that the vehicle does not experience a bump.

In a preferred form, the biasing means acting upon the lock member comprises a friction element moveably mounted to the lock member for movement between an extended and a retracted position. The friction element having a surface for slideable engagement with the upper surface of the base. A friction element biasing means is provided for biasing the friction element in the extended position. In the extended position, the friction element maintains the lower end of the lock element above the upper surface of the base plate. In the retracted position, the lower end of the lock member may contact the base plate.

In another preferred form, the biasing means acting upon the lock member comprises a friction element moveably mounted to the base for movement between an extended position and a retracted position. The friction element has a surface for slideable engagement with the lower end of the lock member. A friction element baising means is provided for biasing the friction element in the extended position. The lock mechanism further comprises a striker having a leading edge which can receive the lower end of the lock member. In the extended position, the leading edge of the strike plate is shrouded from contact by the lower end lock member. In the retracted position, the lower end of the lock member may be captured against the leading edge of the strike plate.

In another preferred form, the friction element can be replaced by other means, such as by a roller plate having spring-biased, telescoping rollers mounted thereon. Such a speed bump works essentially the same way as that described above. Namely, when a vehicle engages the speed bump above a predetermined speed, the roller plate becomes engaged with the strike plate and the vehicle experiences a hard bump. When the vehicle engages the speed bump below the predetermined speed, the roller plate smoothly rolls away, flattening the speed bump so that the vehicle does not experience a bump. The predetermined speed can be altered by changing the spring rate, length, and/or pre-load in the springs that bias the telescoping rollers. This arrangement is quieter in use and provides for longer life (due to rolling contact, rather than sliding contact).

The device may utilize a separate rear pivot member hingedly connected at its upper end to the front pivot member. The rear pivot member protects the lock member, friction element and friction element biasing means from impact by the tires of a vehicle approaching the speed bump from the rear. The lower end of the rear pivot member may rest upon the strike plate, or base plate, and in operation, will collapse to a horizontal position with the collapse of the front pivot and lock members. The lower end of the rear pivot member may be hingedly connected to a sliding member. The sliding member is restrained to move horizontally and substantially parallel to the base plate. The horizontal movement of the sliding member may be limited to control the range of motion of the front pivot member, lock member and rear pivot member.

In a further preferred form, the device includes one or more rear plates pivotally coupled to the front and/or rear plate, a lock plate pivotally coupled to the front and/or rear plate between the front and rear plates, and a sensor associated with the lock plate. The sensor can be provided by a spring-biased retractable support member that is coupled to and biased generally downward from the lock plate so that the support member can engage the base plate. Alternatively, the sensor can be provided by a spring-biased sensor rod extending from a rider member with a ramp and engaged by a lock pin extending from the lock plate. In a further alternative, the sensor can be provided by a spring-biased sensor rod extending from the lock plate and engaging a ramp attached to the base plate.

The present invention addresses the need in the art by providing a speed bump that automatically discriminates between vehicles traveling at different speeds. The invention does so by providing a bump to vehicles traveling above the predetermined speed, while not providing a bump to those vehicles traveling below the predetermined speed. The speed bump of the present invention is rugged, has few moving parts, and provides an inexpensive way to mechanically provide automatic operation of a speed bump based solely on the speed of a vehicle.

Accordingly, it is an object of the present invention to provide an automatic speed bump that is operative based on the speed of the vehicle that contacts the bump.

It is another object of the present invention to provide an automatic speed bump that provides a bump for vehicles traveling above a predetermined speed, but does not provide a bump for vehicles traveling below the predetermined speed.

It is another object of the present invention to provide an automatic speed bump that can be inexpensively constructed to mechanically provide automatic operation of a speed bump based on the speed of a vehicle. These and other objects, advantages, and features of the present invention will become apparent upon reading the following specification in conjunction with the accompanying drawing figures.

BRIEF DESCRIPTION OF THE DRAWINGS

FIG. 12 is a side view of a speed bump according to a fourth preferred form of the present invention, showing the speed bump in a raised, approach position.

FIG. 13 is a cross section view of a sensor of the speed bump of FIG. 12.

FIG. 14 is a side view of the speed bump of FIG. 12, showing how the speed bump locks in an inclined position to provide a bump for a vehicle traveling above a predetermined speed as the vehicle passes over the speed bump.

FIG. 15 is a cross section view of the sensor of the speed bump of FIG. 14.

FIG. 16 is a side view of the speed bump of FIG. 12, showing how the speed bump collapses to a horizontal position for a vehicle traveling below a predetermined speed as the vehicle passes over the speed bump.

FIG. 17 is a cross section view of the sensor of the speed bump of FIG. 16.

DETAILED DESCRIPTION OF THE PREFERRED EMBODIMENTS

Figure 1:
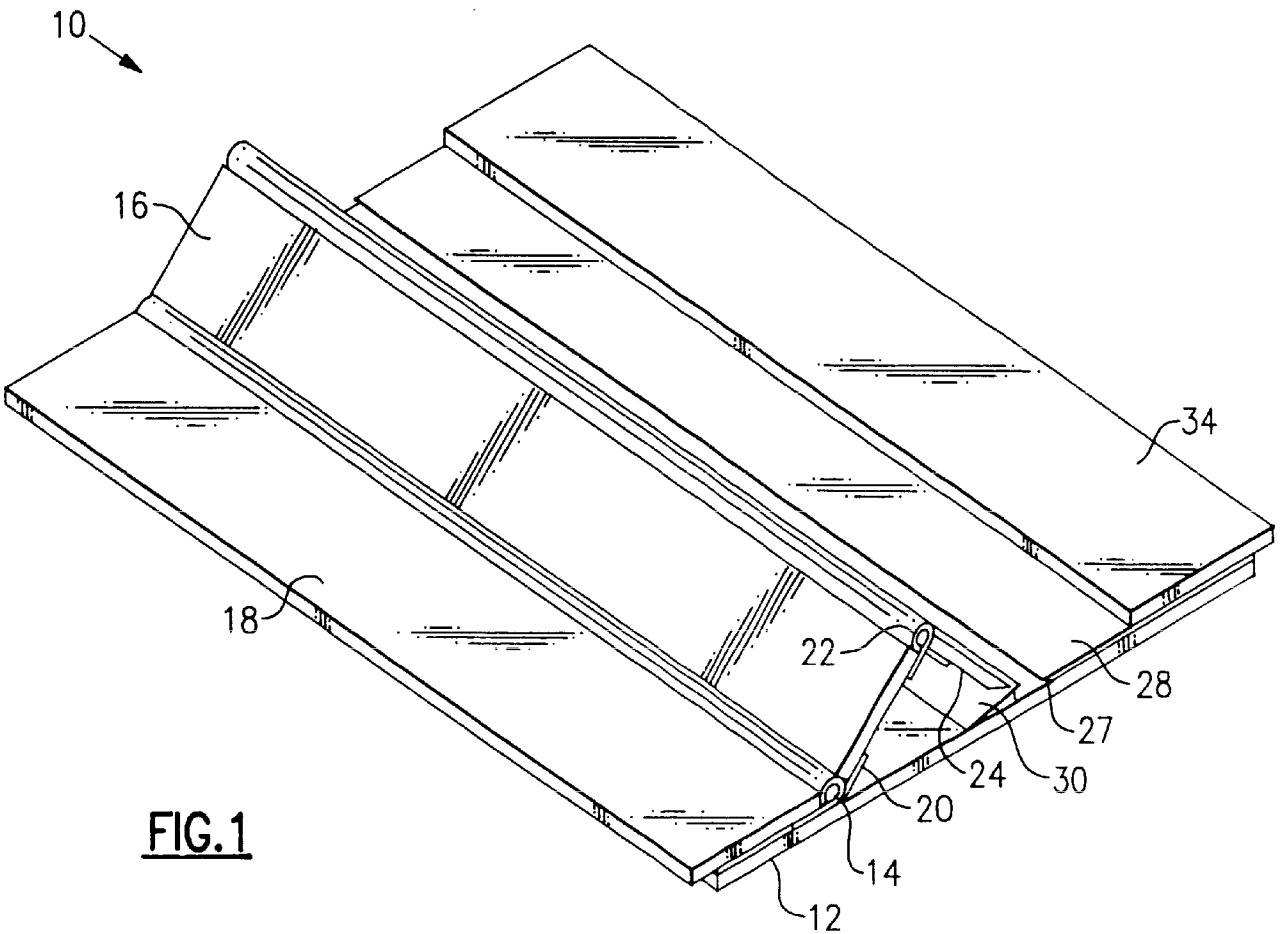
FIG. 1 is a perspective illustration of a speed bump according to a first preferred form of the present invention.
Figure 2:
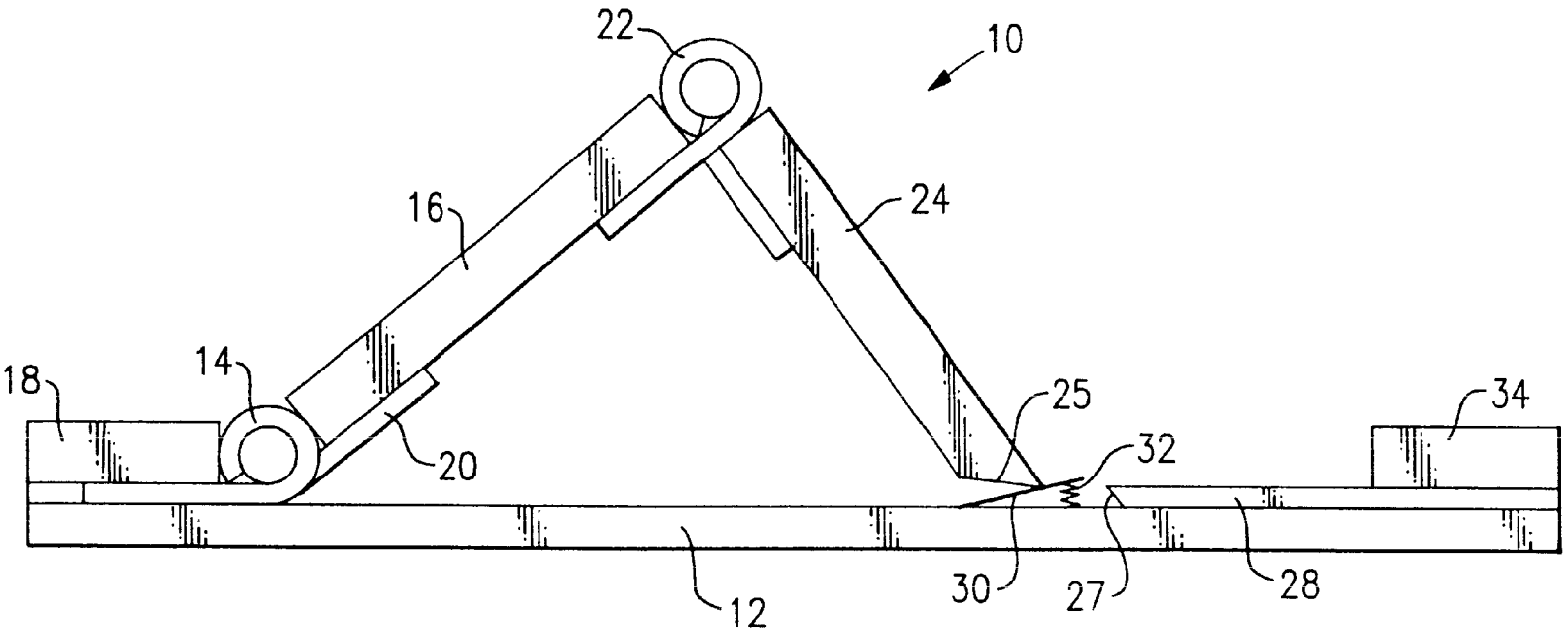
FIG. 2 is a side view of the speed bump of FIG. 1.

Referring now to the drawing figures, wherein like reference numerals represent like parts throughout the several views, FIGS. 1 and 2 show an illustrative embodiment of the speed bump of the present invention, represented by general reference numeral 10. The speed bump 10 includes a base plate 12 that can be mounted on top of the pavement or recessed into the pavement. A bottom hinge 14 is connected to the base plate 12 and a lower end of a front plate 16. In this manner, the front plate is hingedly connected to the base plate. A leading horizontal plate 18 is connected to base plate in front of the front plate to create an even surface for vehicles tires when approaching the speed bump.

A spring means, such as torsion spring 20, biases the front plate upwardly such that it is maintained at a predetermined angle in the absence of any force acting on the front plate. This angle is approximately 45 degrees, but other angles can be suitable. It will be understood that the speed bump typically is to be installed in the driving surface such that the tire of an approaching vehicle first rolls over the leading horizontal plate and then contacts the inclined front plate.

A top hinge 22 is connected between the upper end of the front plate and the upper end of a lock plate 24 such that the front and lock plates are hingedly connected to each other. Note that no torsion spring or other means is needed for urging the lock plate toward or away from the front plate. Thus, the lock plate is able to rotate freely about the top hinge relative to the front plate. However, the rotation of the lock plate toward the front plate is limited by a friction plate, as will be described below.

The lower end 25 of the lock plate is beveled such that it can be received in a recess formed by a reverse beveled end 27 of strike plate 28. The striker or strike plate 28 and an upper surface of base plate 12 are connected to the base plate 12 to position the leading edge of bevel 27 at a predetermined distance from the bottom hinge 14. The predetermined distance at which the strike plate is located is such that when the lower end of the lock plate is received against the strike plate, the front plate is maintained at an inclined position. Changing the location of the strike plate changes the inclination of the front plate when the speed bump is locked in position, as described below.

The beveled end of the lock plate rests on a friction plate 30, but is not attached or connected to the friction plate, so it is slidable across the upper surface of the friction plate. One end of the friction plate 30 is hingedly connected to the base plate and the other end, near the strike plate, is urged upwardly by a friction plate spring 32, shown in FIG. 2 as a coil spring. It will be understood that the friction plate may be urged upwardly not only by a coil spring, but by any suitable biasing means. A trailing horizontal plate 34 is connected on top of the strike plate to create a level surface for the tires of a vehicle when the lock plate slides over the strike plate to a substantially flat, horizontal position.

In operation, as shown in FIGS. 3 and 4, a wheel of a vehicle advances over the leading horizontal plate 18 and contacts the front plate 16. The overall height of the speed bump is typically no more than about 12 inches, so that the tires of a typical vehicle are usually at least twice the height of the speed bump. As the tire contacts the front plate, the front plate is forced into a clockwise rotation about the bottom hinge. This, in turn, causes the lock plate to be rotated slightly counterclockwise about the top hinge. In this way, the lower beveled end of the lock plate slides over the friction plate in a direction toward the strike plate.

It should be understood that a vehicle traveling at a high speed will impact the front plate of the speed bump more forcefully than will a vehicle traveling at a slower speed. Therefore, the spring rates and sizes of the torsion spring and the friction plate spring are chosen to set the speed bump to operate at a predetermined speed. For example, if the speed bump is installed on a road with a speed limit of 30 mph, then the springs should be chosen much firmer than those for a speed bump installed in a parking lot where the speed of vehicles contacting the speed bump is typically much lower.

Figure 3A:
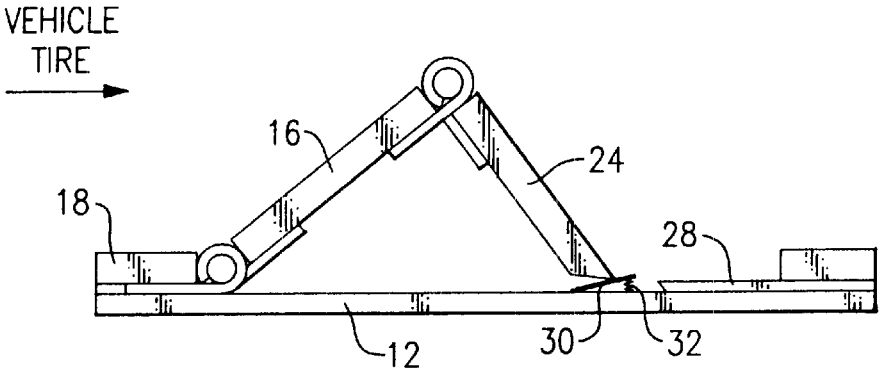
FIGS. 3A–C demonstrate how the speed bump of FIG. 1 locks in an inclined position to provide a bump for a vehicle traveling above a predetermined speed as the vehicle passes over the speed bump.
Figure 3B:
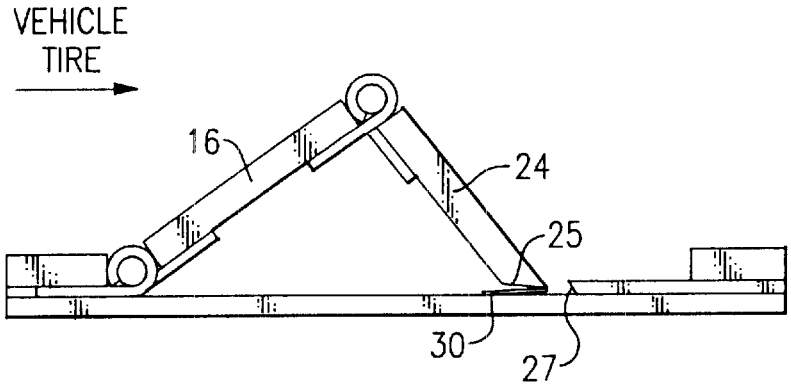
Figure 3C:
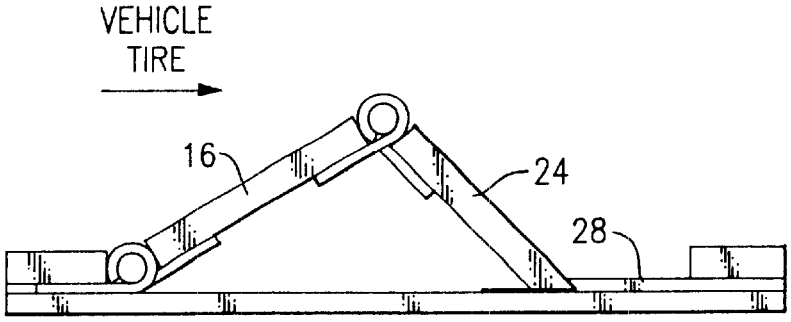
Figure 4A:
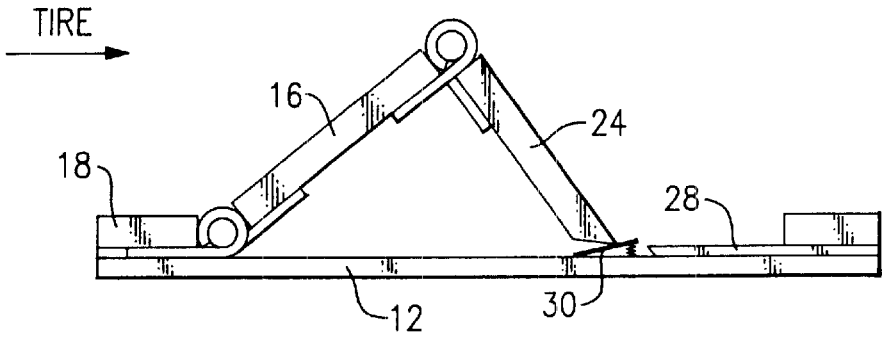
FIGS. 4A–E demonstrate how the speed bump of FIG.1 collapses to a horizontal position for a vehicle traveling below a predetermined speed as the vehicle passes over the speed bump.
Figure 4B:
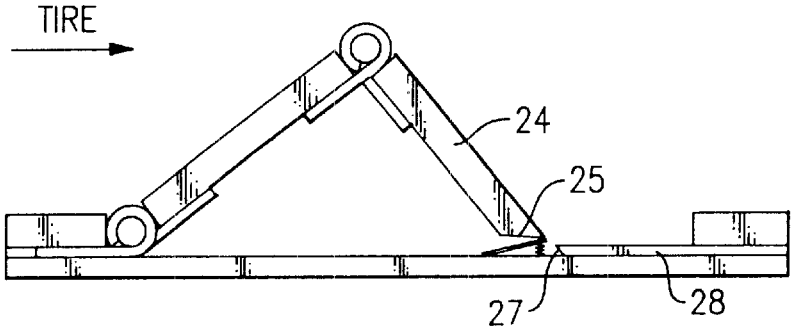
Figure 4C:
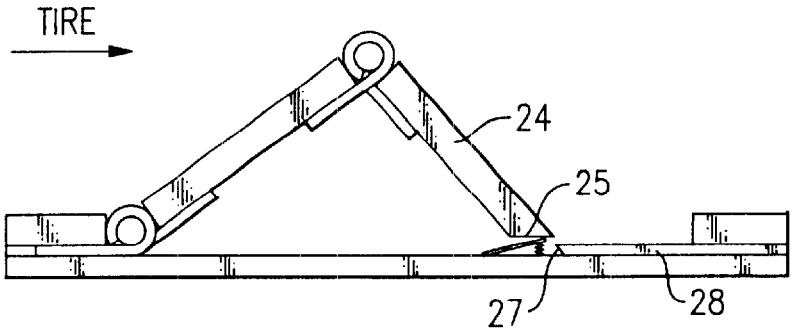
Figure 4D:
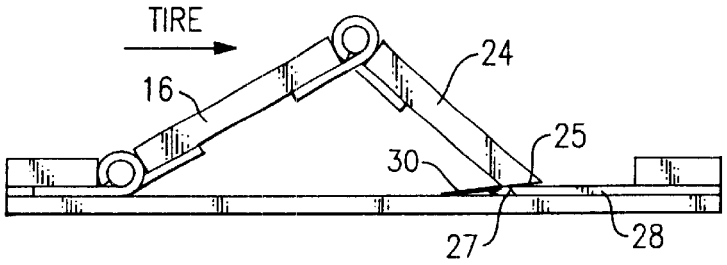
Figure 4E:
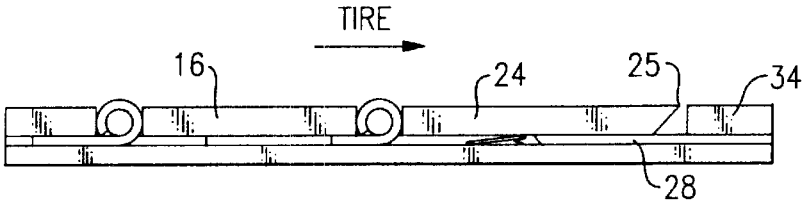

In this manner, the speed bump of the present invention can be set to operate at a predetermined speed. As shown in FIGS. 3A–C, when a vehicle exceeds a predetermined speed, the force of the tires impacting on the front plate causes the lock plate to be driven downwardly rapidly enough and with enough force to depress the friction plate downwardly against the friction plate spring such that the beveled end of the lock plate moves downwardly and is received against the reverse beveled end of the strike plate. In FIG. 3A, the tire of the vehicle first contacts the front plate. In FIG. 3B, the force of the tire on the front plate causes the lock plate to be driven downwardly to depress the friction plate against the friction plate spring. At the same time, the beveled end of the lock plate slides rearwardly on the friction plate toward the strike plate. Because the tire imparts enough force to cause the lock plate to depress the friction plate quickly as the lock plate slides on the friction plate, and before the lock plate slides completely off of the friction plate, the beveled edge of the lock plate is received in the reverse beveled end of the strike plate, as shown in FIG. 3C. This prevents any further rearward movement of the lock plate, and therefore locks the speed bump in place, as shown in FIG. 3C. Thus, if the vehicle's speed exceeds the predetermined speed, which may be set to equal the speed limit or other acceptable speed, then the front plate of the speed bump remains inclined and the vehicle experiences a hard bump. After the vehicle passes over the speed bump, the speed bump returns to the position shown in FIG. 3A because the absence of force on the front plate allows the torsion spring to urge the front plate upwardly to an inclined position, and the friction plate spring biases the friction plate upwardly, with the beveled end of the lock plate resting on the friction plate. However, if the vehicle's speed is less than the predetermined speed, then the speed bump collapses such that the front and lock plates become essentially horizontal, as shown in FIGS. 4A–E. In FIG. 4A, the tire of the vehicle contacts the front plate. If the vehicle is traveling below the predetermined speed, as determined by the spring rates and sizes of the torsion spring and friction plate spring, the lesser force imparted by the tires of the slower moving vehicle on the front plate causes the lock plate to drive the friction plate downwardly against the friction plate spring to a lesser degree and more slowly than for a faster vehicle, as shown in FIG. 4B. At the same time, the lock plate slides on the friction plate toward the strike plate. Because the impact of the tires does not impart enough force to cause the lock plate to depress the friction plate against the friction plate spring far enough and fast enough, the lock plate slides over the friction plate but does not engage the reverse beveled end of the strike plate, as shown in FIG. 4C. Instead, the lock plate slides off of the friction plate and onto the top surface of the strike plate, as shown in FIG. 4D. As the tires travels over the speed bump, the rearward movement of the lock plate is not obstructed, and the front plate and lock plate collapse to a horizontal position, as shown in FIG. 4E. In this manner, the vehicle traveling below the predetermined speed does not experience a bump. After the vehicle passes over the lock plate, the speed bump returns to the position shown in FIG. 4A because the absence of force on the lock plate allows the torsion spring to urge the front plate upwardly to an inclined position, and the beveled end of the lock plate returns to rest on the friction plate, which is biased upwardly by the friction plate spring.

Figure 5:
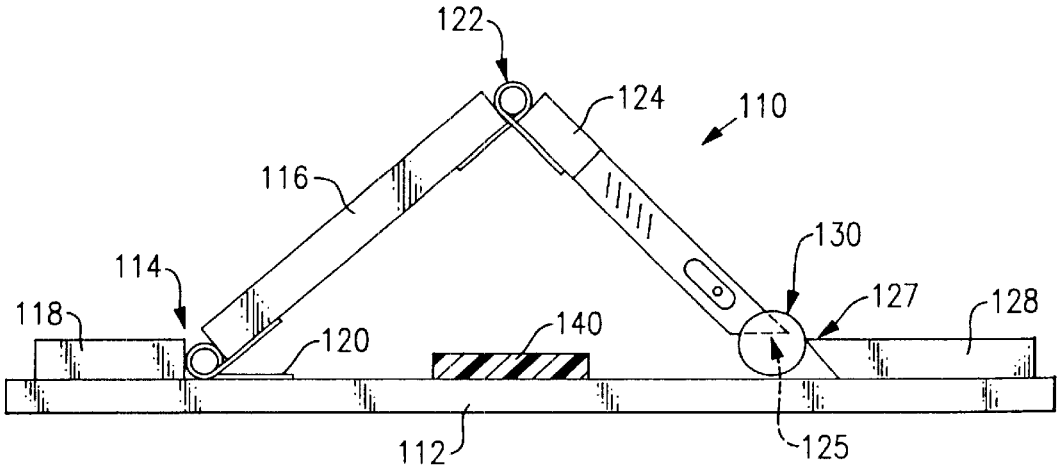
FIG. 5 is a side view of a speed bump according to a second preferred form of the present invention.
Figure 6:
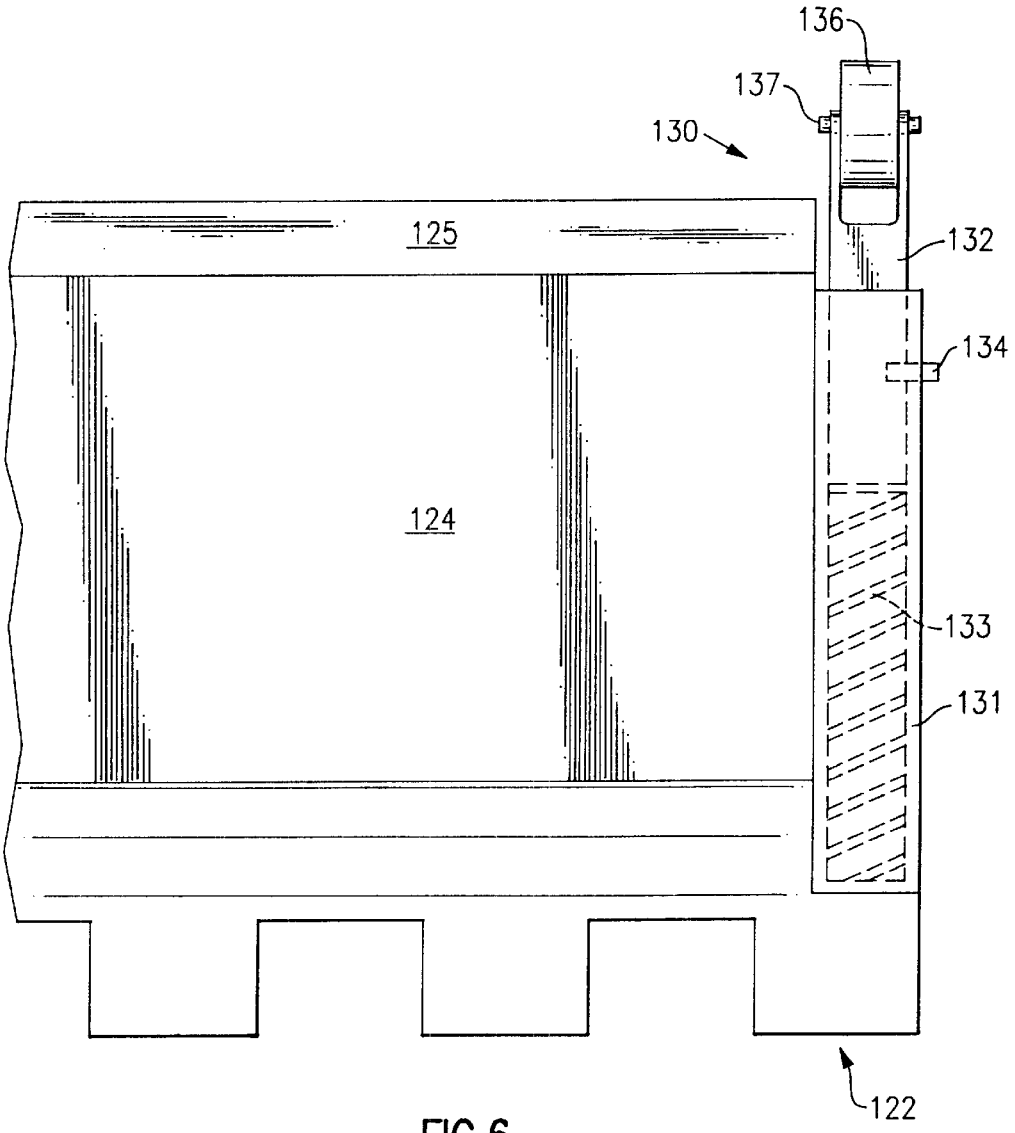
FIG. 6 is a bottom view of a portion of the speed bump of FIG. 5.
Figure 7:
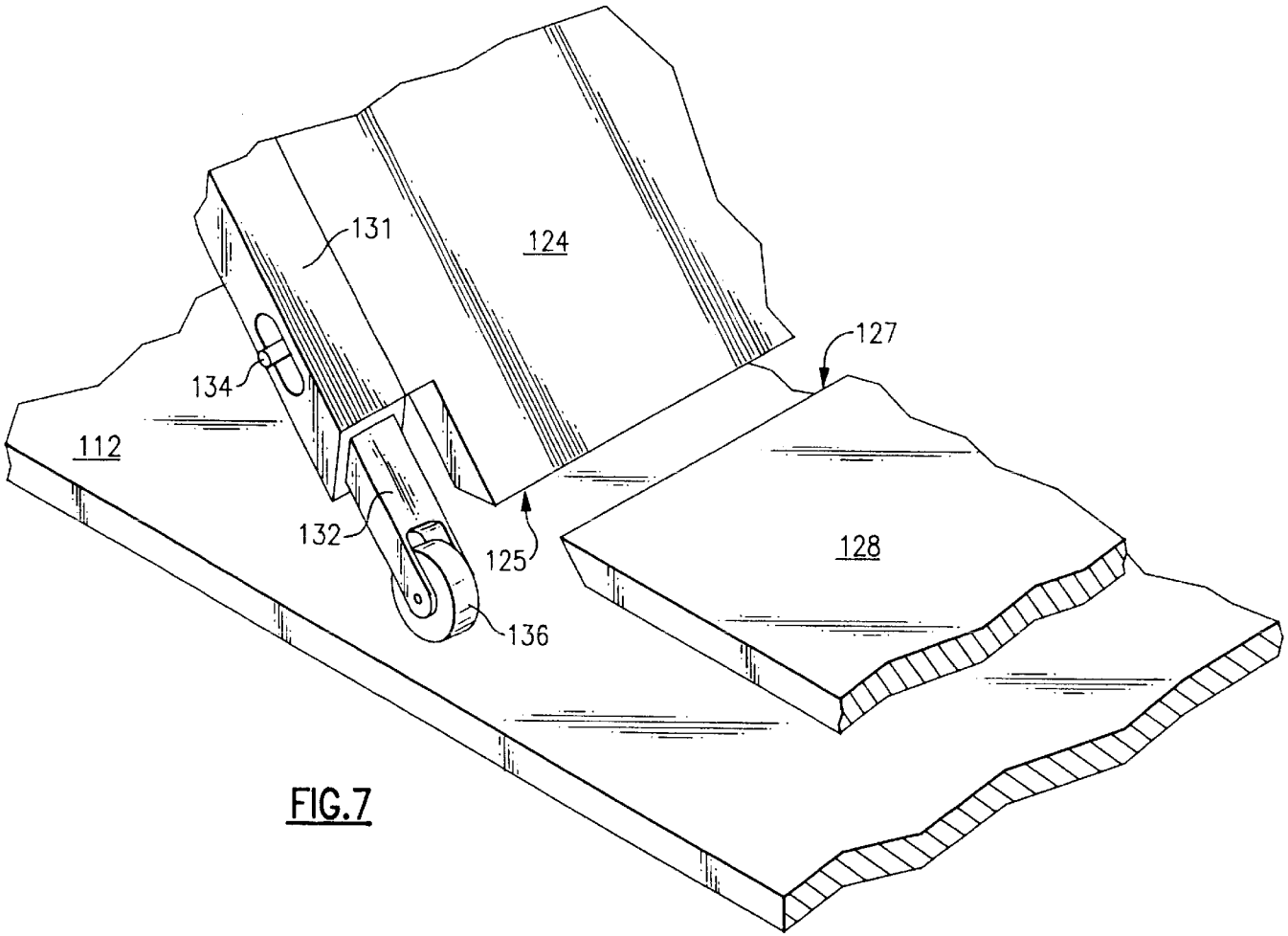
FIG. 7 is a perspective illustration of a portion of the speed bump of FIG. 5.

FIGS. 5–7 show the speed bump of the present invention in a second preferred form, represented by general reference numeral 110. The speed bump 110 includes a base plate 112 that can be mounted on top of the pavement or recessed into the pavement. A piano hinge 114 is connected to the base plate 112 and to a lower end of a front plate 116. In this manner, the front plate is hingedly connected to the base plate. A leading horizontal plate 118 is connected to base plate in front of the front plate to create an even surface for vehicles tires when approaching the speed bump.

A spring means, such as torsion spring 120, biases the front plate upwardly such that it is maintained at a predetermined angle in the absence of any force acting on the front plate. A top piano hinge 122 connects the upper end of the front plate 116 and the upper end of a lock plate or lock member 124 such that the front and lock plates are hingedly connected to each other. Note that no torsion spring or other means is needed for urging the lock plate toward or away from the front plate. Thus, the lock plate is able to rotate freely about the top hinge relative to the front plate.

The central section of a lower end of the lock plate includes a beveled edge 125 such that it can be received in a recess formed by a reverse beveled end 127 of strike plate 128. The striker or strike plate 128 is connected to the base plate 112 to position the leading edge or bevel 127 at a predetermined distance from the bottom hinge 114. The predetermined distance at which the strike plate is located is such that when the lower end of the lock plate is received against the strike plate, the front plate is maintained at an inclined position. Changing the location of the strike plate changes the inclination of the front plate when the speed bump is locked in position.

The beveled end of the lock plate is supported over the base plate 112 by a pair of outboard rollers, such as roller 130. As best seen in FIG. 6 and FIG. 7, the outboard roller 130 is welded to an edge of the lock plate 124 and includes a fork housing 131 telescopically receiving a telescoping fork 132. The telescoping fork 132 is urged outwardly by a compression spring 133, with the outward movement thereof limited by a limit pin 134. The telescoping fork 132 straddles a rotatable wheel 136 rotatably mounted to the fork 132 by an axle 137.

As seen in the figures, the telescoping fork 132 extends in the same plane as that of the lock plate 124. This provides a simple, compact arrangement. However, it is possible to reorient the telescoping roller so that the relative movement is not in the same plane as the lock plate, although at the expense of some additional complexity and loss of some compactness.

The roller 130 extends beyond the beveled edge 125 of the lock plate 124. In this way, the roller supports the beveled edge above the base plate 112. The outboard roller is configured to support the beveled edge 125 a distance above the base plate 112 slightly greater than the height of the striker 128.

As seen in FIG. 6, the upper hinge 122 is in the form of a piano hinge, with FIG. 6 showing the alternating hinge sections of the lock plate 124. Those skilled in the art will recognize that the front plate has complementary hinge sections and a hinge pin is driven through these hinge sections when co-aligned.

To minimize noise and to reduce mechanical shock in use, a rubber snubber 140 is mounted atop the base plate 112 half-way between the front piano hinge 114 and the striker 128. In this way, as the front plate and the lock plate are driven downwardly toward the base plate, the rubber snubber operates to absorb some mechanical shock and to reduce noise that would otherwise occur as the front and lock plate impact the base plate.

Figure 8:
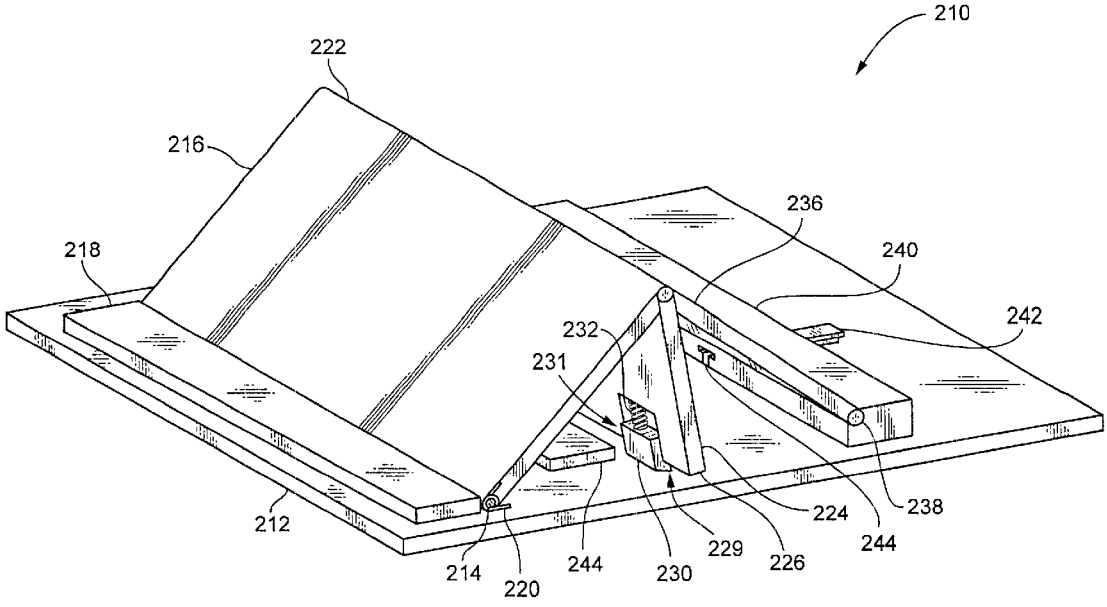
FIG. 8 is a perspective illustration of a speed bump according to a third preferred form of the present invention.
Figure 9:
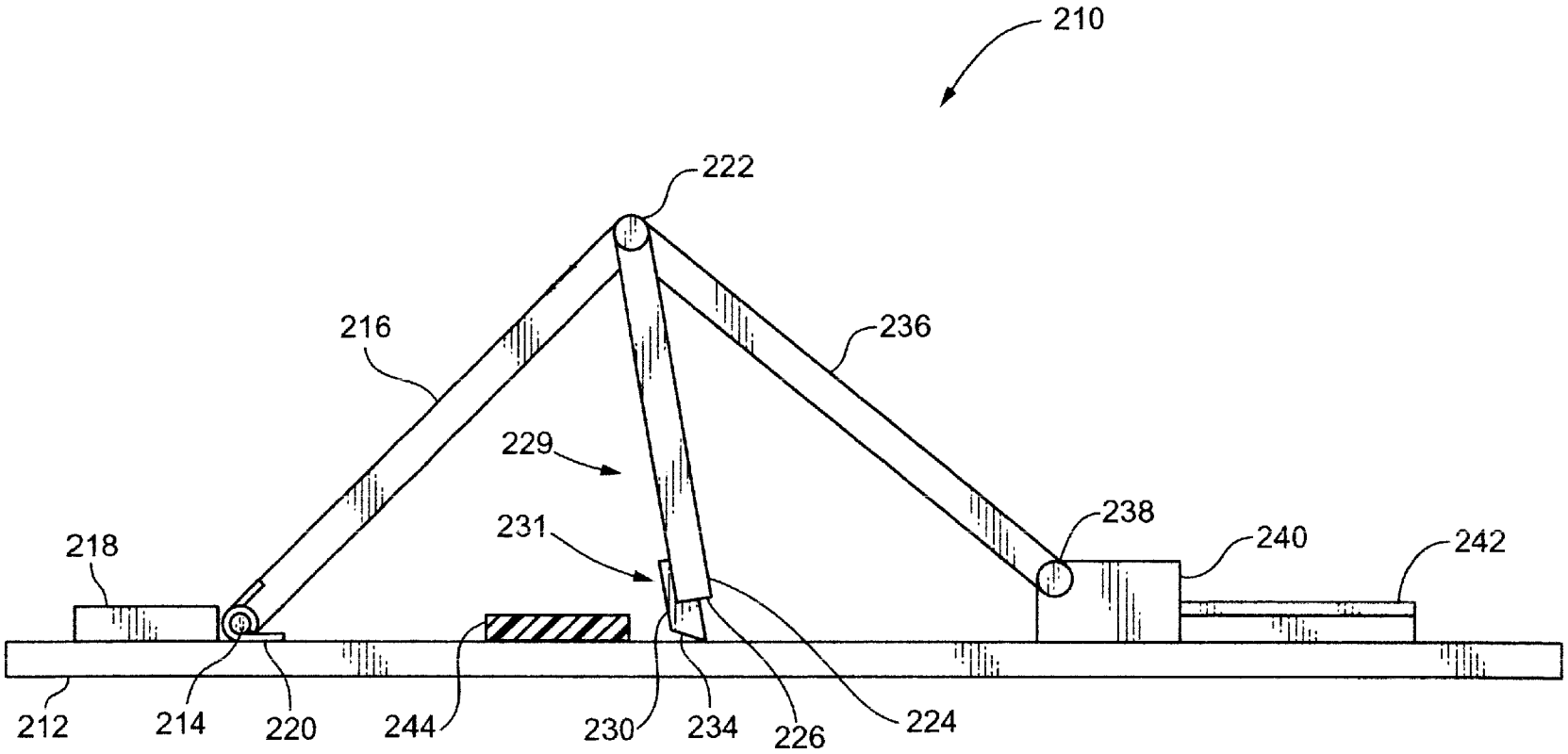
FIG. 9 is a side view of the speed bump of FIG. 8.

FIGS. 8 and 9 show the speed bump of the present invention in a third preferred form, represented by general reference numeral 210. The speed bump 210 includes a base plate 212 that can be mounted on top of the pavement or recessed into the pavement. A bottom hinge 214 is connected to the base plate 212 and a lower end of a front plate 216. In this manner, the front plate 216 is hingedly connected to the base plate 212. A leading horizontal plate 218 is connected to base plate in front of the front plate to create an even surface for vehicles tires when approaching the speed bump.

A support spring means, such as torsion spring 220, biases the front plate upwardly such that it is maintained at a predetermined angle in the absence of any force acting on the front plate. This angle is approximately 45 degrees, but other angles can be suitable. It will be understood that the speed bump typically is to be installed in the driving surface such that the tire of an approaching vehicle first rolls over the leading horizontal plate 218 and then contacts the inclined front plate 216.

A lock mechanism 229 includes a lock member 224 and a sensor 231 connected thereto. The lock member 224 is provided by a metal plate, but alternatively can be provided by a bar, rod, pipe, finger, arm, or the like made of another material. A top hinge 222 is connected between the upper end of the front plate and the upper end of the lock plate 224 such that the front and lock plates are hingedly connected to each other. The sensor 231 includes a retractable support member 230 that is mounted to the lower portion of lock plate 224 for movement between an extended and a retracted position. The retractable support member 230 is provided by a metal bar, but alternatively can be provided by a block, plate, rod, pipe, finger, arm, or the like made of plastic, nylon, or another material. The retractable support 230 is urged to an extended position by a coil or other sensor spring 232. It will be understood that the retractable support 230 may be urged to extend not only by a coil spring, but by any suitable biasing means.

The lower edge 234 of retractable support 230 rests on the base plate 212, but is not attached or connected to the base plate, so it is slidable across the upper surface of the base plate. The lower edge 234 of the retractable support is beveled to promote slidable engagement across the upper surface of the base plate. In the extended position, the lower edge 234 of the retractable support rests upon the base plate and supports the lower edge 226 of lock plate above the upper surface of the base plate.

When the retractable support 230 is forced into the retracted position, the lower edge 226 of the lock plate 224 can be received against base plate 212. The length of the lock plate is such that when the lower end of the lock plate is received against the base plate, the front plate is maintained at an inclined position. Changing the length of the lock plate changes the inclination of the front plate when the speed bump is locked in position, as described below.

A rear plate 236 is hingedly connected to the top of front plate 216 by top hinge 222. As may be appreciated by one skilled in the art, the lock plate may also be hingedly connected to either the front plate 216 or rear plate 236. A lower hinge 238 is connected between the lower end of rear pivot 236 and a sliding plate 240. The sliding plate is constrained to move linearly and parallel to the base by a "T" shaped guide 242 which engages a complimentary shaped opening 244 in the sliding plate. It will be understood that the sliding plate may constrained not only by a "T" shaped guide, but by another suitable guide means of another regular or irregular shape.

To minimize noise and reduce mechanical shock in use, a rubber snubber 244 is mounted atop the base plate 212. As the front plate 216, lock plate 224, and rear plate 236 are driven downwardly toward the base plate, the rubber snubber operates to absorb some of the mechanical shock and to reduce noise that would otherwise occur as the front, lock and rear plates impact the base plate.

In operation, as shown in FIGS. 10 and 11, a wheel of a vehicle advances over the leading horizontal plate 218 and contacts the front plate 216. The overall height of the speed bump is typically no more than about 12 inches, so that the tires of a typical vehicle are usually at least twice the height of the speed bump. As the tire contacts the front plate, the front plate is forced into a clockwise rotation about the bottom hinge. This, in turn, causes the lock plate 234 to be driven downward toward the base plate 212.

It should be understood that a vehicle traveling at a high speed will impact the front plate of the speed bump more forcefully than will a vehicle traveling at a slower speed. Therefore, the sensor spring rates and sizes of the torsion spring and the retractable support spring are chosen to set the speed bump to operate at a predetermined speed. For example, if the speed bump is installed on a road with a speed limit of 30 mph, then the sensor springs should be chosen much firmer than those for a speed bump installed in a parking lot where the speed of vehicles contacting the speed bump is typically much lower. In this manner, the speed bump of the present invention can be set to operate at a predetermined speed.

Figure 10A:
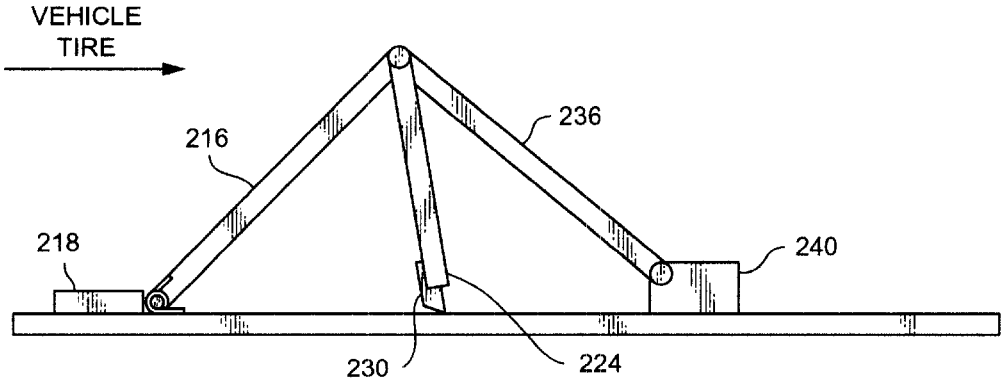
FIG. 10 is a side view of the speed bump of FIG. 8, showing how the speed bump locks in an inclined position to provide a bump for a vehicle traveling above a predetermined speed as the vehicle passes over the speed bump.
Figure 10B:
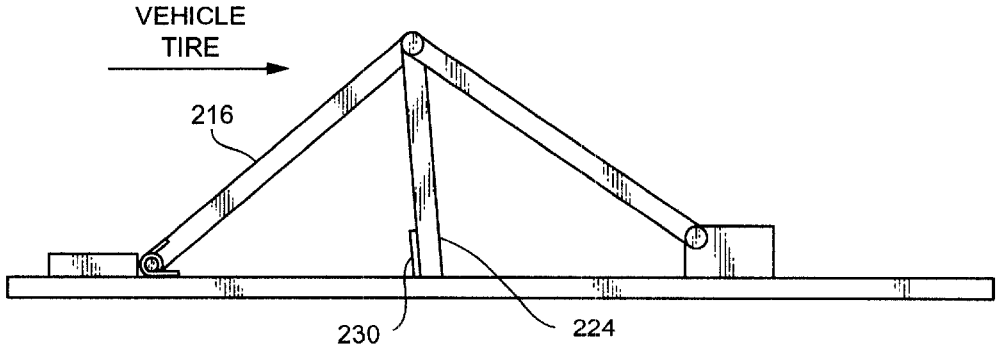

As shown in FIGS. 10A–B, when a vehicle exceeds a predetermined speed, the force of the tires impacting on the front plate 216 causes the lock plate 224 to be driven downwardly rapidly enough and with enough force to retract the retractable support 230 such that the lower edge 226 of the lock plate is received against the base plate 212. In FIG. 10A, the tire of the vehicle first contacts the front plate. In FIG. 10B, the force of the tire on the front plate causes the lock plate to be driven downwardly to retract the retractable support against the sensor spring. At the same time, the lock plate/retractable support assembly slides rearwardly on the base plate. Because the tire imparts enough force to cause the lock plate to be driven downward quickly, as the lock plate/retractable support assembly slides on the base plate, the lower edge of the lock plate is received against the base plate. Sufficient friction force is generated between the lock plate lower edge and the base plate to preclude additional sliding of the lock plate upon the base plate. This friction prevents any further rearward movement of the lock plate, and therefore locks the speed bump in place, as shown in FIG. 10B. Thus, if the vehicle's speed exceeds the predetermined speed, which may be set to equal the speed limit or other acceptable speed, then the front plate of the speed bump remains inclined and the vehicle experiences a hard bump. After the vehicle passes over the speed bump, the speed bump returns to the position shown in FIG. 10A because the absence of force on the front plate allows the torsion spring to urge the front plate upwardly to an inclined position, and the retractable support spring biases the lock plate upwardly with the beveled lower edge 234 of the retractable support resting on the base plate.

Figure 11A:
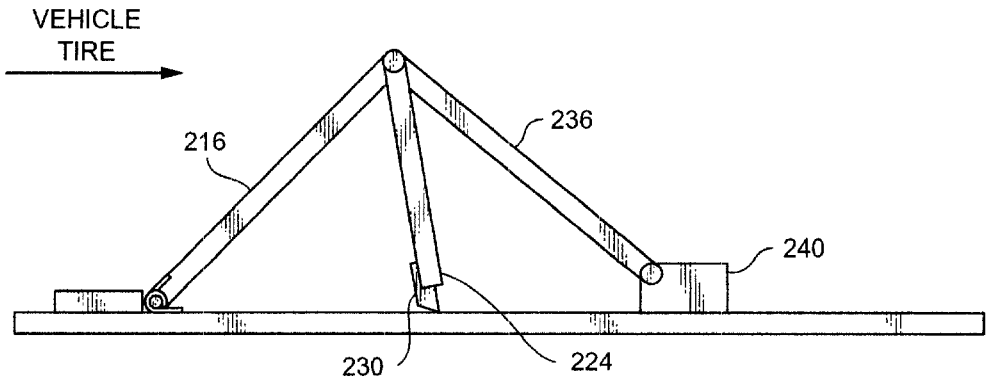
FIG. 11 is a side view of the speed bump of FIG. 8, showing how the speed bump collapses to a generally horizontal position for a vehicle traveling below a predetermined speed as the vehicle passes over the speed bump.
Figure 11B:
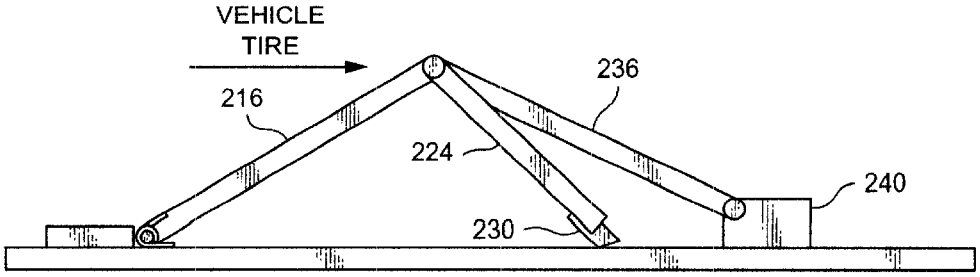
Figure 11C:
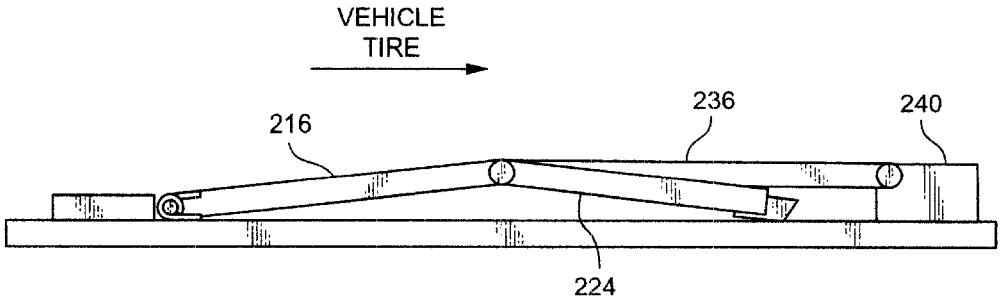

However, if the vehicle's speed is less than the predetermined speed, then the speed bump collapses such that the front, lock and rear plates become essentially horizontal, as shown in FIGS. 11A–C. In FIG. 11A, the tire of the vehicle contacts the front plate. If the vehicle is traveling below the predetermined speed, as determined by the spring rates and sizes of the front plate torsion spring 220 and retractable sensor spring 232, the lesser force imparted by the tires of the slower moving vehicle on the front plate 216 causes the lock plate 224 to be driven downwardly against the retractable support spring to a lesser degree and more slowly than for a faster vehicle, as shown in FIG. 11B. At the same time, the lock plate/retractable support assembly slides rearwardly on the base plate 212. Because the impact of the tires does not impart enough force to cause the lock plate to be driven downward far enough and fast enough, the retractable support 230 is maintained in an extended position by the retractable support spring, and the lock plate is prevented from making firm contact with the upper surface of the base plate. Instead, the lock plate/retractable support assembly slides rearward upon the base plate, as shown in FIG. 11B. As the tire travels over the speed bump, the rearward movement of the lock plate is not obstructed, and the front, lock and rear 236 plates collapse to a horizontal position, as shown in FIG. 11C. In this manner, the vehicle traveling below the predetermined speed does not experience a bump. After the vehicle passes over the lock plate, the speed bump returns to the position shown in FIG. 11A because the absence of force on the lock plate allows the torsion spring to urge the front plate upwardly to an inclined position, and the retractable support spring biases the lock plate upwardly with the beveled lower edge 234 of the retractable support resting on the base plate.

FIG. 12 shows the speed bump of the present invention in a fourth preferred form, represented by general reference numeral 310. Similar to the third preferred speed bump 210, the speed bump 310 includes a base plate 312, a bottom hinge 314, a front plate 316, a top hinge 322, and a lock mechanism 329. The lock mechanism 329 has a lock plate 324 with at least one locking pin 325 extending therefrom that engages and is operable by at least one sensor 331 coupled to the base plate 312. In a typical commercial embodiment, the speed bump can have two pins 325 and two sensors 331, each positioned at an end of the lock plate 324.

In this form of the speed bump 310, a first rear plate 336 is hingedly connected to the top of front plate 316 by top hinge 322, and a second rear plate 337 is hingedly connected to the base 312. The first and second rear plates 336 and 337 overlap at least some distance and contact each other, and slide relative to each other when the vehicle travels over the speed bump. To minimize noise and reduce mechanical friction and shock in use, friction reducing members 339 and 341 can be provided between the first and second rear plates 336 and 337 and an assist member 343 such as a plate or the like. Also, a support spring mechanism (as shown and described in the fifth preferred embodiment below) can be provided to bias the first and second rear plates 336 and 337 into the approach position. As the front plate 316, lock plate 324, and rear plates 336 and 337 are driven downwardly toward the base plate, the friction reducing members 339 and 341 operate to absorb some of the mechanical friction and shock and to reduce noise that would otherwise occur as the front, lock and rear plates slide against each other. It will be understood that the friction reducing members 339 and 341 can be provided by a nylon, plastic, metal, graphite, elastomeric, composite, or other material, with or without a lubricating material.

FIG. 13 shows the components of the sensor 331, including a base member 344 having a ramp 354 (see FIG. 12), a sensor rod 346 having an extension member 347 (see FIG. 12) with an engagement surface, a dowel 349, a sensor spring 350, and a retainer 352. As discussed above, a vehicle traveling at a high speed will impact the front plate more forcefully than will a vehicle traveling at a slower speed. Therefore, the rates and sizes of the springs 350 are chosen to set the speed bump to operate at a predetermined speed. The construction of these components will be described below with reference to detailed drawing figures.

Figure 18:
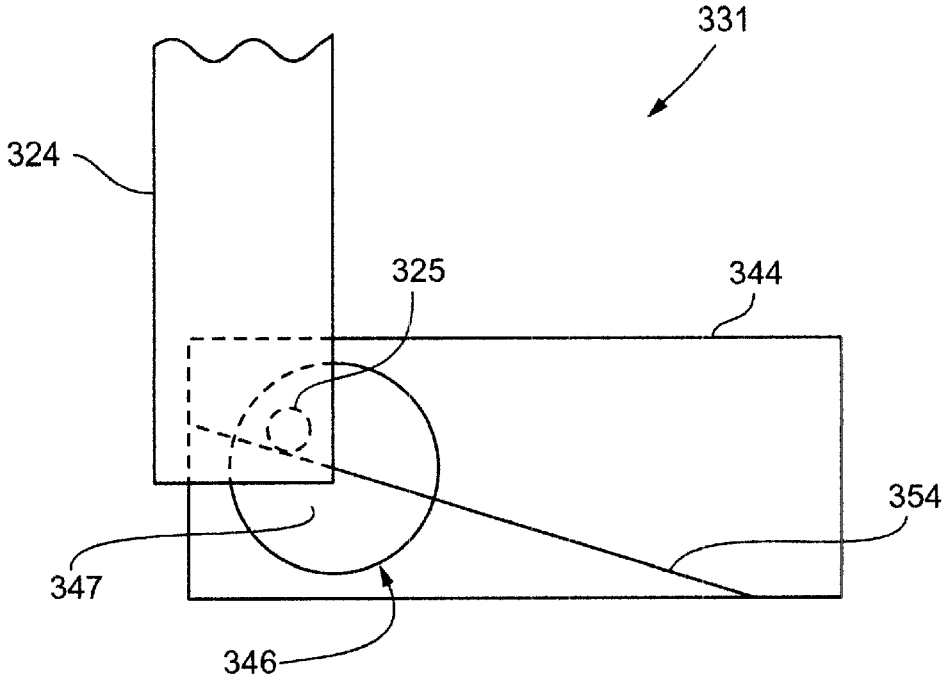
FIG. 18 is a detail view of the sensor of the speed bump of FIG. 14 in the approach position.
Figure 19:
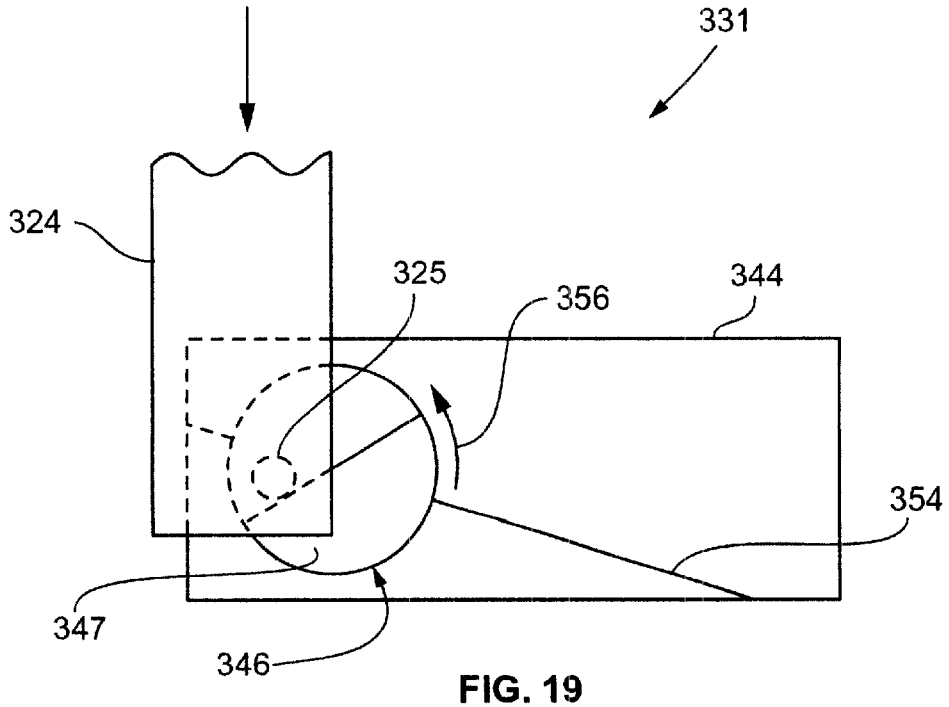
FIG. 19 is a detail view of the sensor of the speed bump of FIG. 16 in the locked position.
Figure 20:
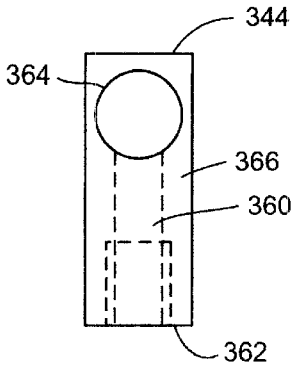
FIG. 20 is a side view of the sensor rider member of the speed bump of FIG. 12.
Figure 21:
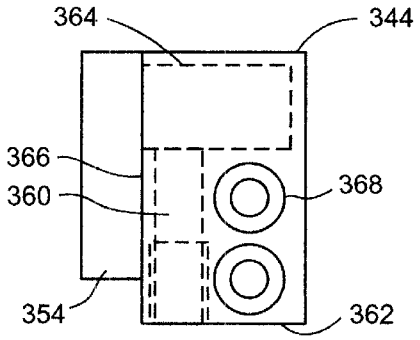
FIG. 21 is a plan view of the sensor rider member of the speed bump of FIG. 20.
Figure 22:
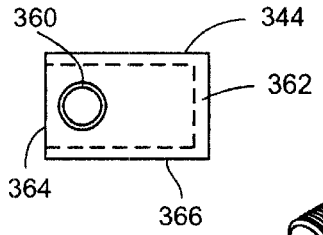
FIG. 22 is an end view of the sensor rider member of the speed bump of FIG. 20.
Figure 23:
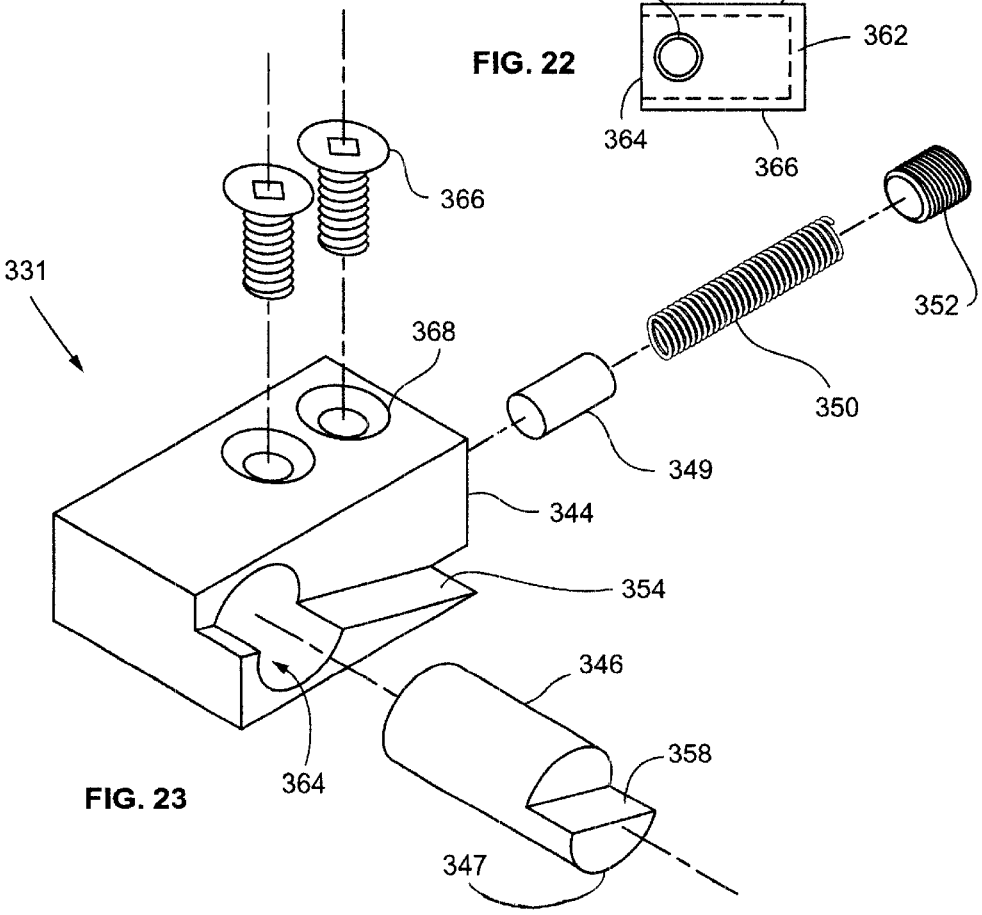
FIG. 23 is an exploded perspective view of the sensor of the speed bump of FIG. 12.

FIGS. 12–19 show the operation of the fourth preferred form of the invention. FIGS. 12, 13 and 18 show the speed bump 310 and the sensor 331 in the approach position, as a vehicle approaches the speed bump. A wheel of a vehicle contacting the front plate 316 causes the lock plate 334 to be driven downward toward the base plate 312. As shown in FIGS. 14, 15, and 19, when the vehicle exceeds a predetermined speed, the force of the tires impacting on the front plate 316 causes the lock plate 324 to be driven downwardly rapidly enough and with enough force to overcome the resistive force of the sensor spring 350. Therefore, the force of the pin 325 on the engagement surface of the extension member 347 of the sensor rod 346 causes the sensor rod 346 to rotate in a first direction 356, thereby retracting the dowel 348 against the sensor spring 350. In this manner, the pin 325 is retained from sliding down the ramp 354 thereby securing the locking plate 324 in an upright, locked position, to discourage drivers from traversing the speed bump at higher than the predetermined speed.

However, as shown in FIGS. 16 and 17, if the vehicle is traveling below the predetermined speed, as determined by the rates and sizes of the sensor spring 350, then the sensor rod 325 will slide across the engagement surface of the extension member 347 of the sensor rod 346, and will slide down the ramp 354. Accordingly, the lock plate 324 pivots, thereby permitting the front, lock and rear plates to collapse such that the speed bump 310 becomes essentially horizontal, as shown in FIG. 16. In thus way, the impact of the speed bump is minimized to drivers traveling below the predetermined speed.

FIGS. 20–23 show the details of the sensor 331, including the rider member 344, the sensor rod 346 having an extension member 347 with the engagement surface 358, the dowel 349, the sensor spring 350, the retainer 352, and the ramp 354. The rider member 344 has an end hole 360 extending through an end wall 362, and a side hole 364 extending through a side wall 366, with the end hole 360 in communication with the side hole 364. The end hole 360 receives the dowel 349, the sensor spring 350, and the retainer 352, while the side hole 364 receives the sensor rod 346, so that the sensor rod 346 engages the dowel 349. Also, the rider member is attached to the base plate 312 or another component of the speed bump by, for example, two or another number of screws 366 that extend through two or another number of holes 368 in the rider member 344. The rider member 344 can be made of nylon, plastic, metal, or another material.

The ramp 354 extends from the side wall 366 of the rider member 344 sufficiently to engage the pin 325 of the lock plate 324. Also, the side hole 364 extends through the ramp 354, so that when the sensor rod 346 rotates in the first direction, the engagement surface 358 and a side wall of the side hole 364 form a notch 368 (see FIG. 19) that retains the pin 325, thereby locking the lock plate 324 in the generally upright, locked position.

The pin 325, sensor rod 346, and the dowel 349 can have a generally cylindrical or other regular or irregular shape, and be made of a metal or other material. The sensor spring 350 is provided by a compression coil spring, or by another spring or elastomeric member. The retainer 352 can be provided by a screw or other structure that is received in the end wall 352 and against which the spring 350 abuts. Where the retainer 352 is provided by a screw or other retractable structure, it can be adjusted to calibrate the sensitivity of the sensor 331.

Figure 24:
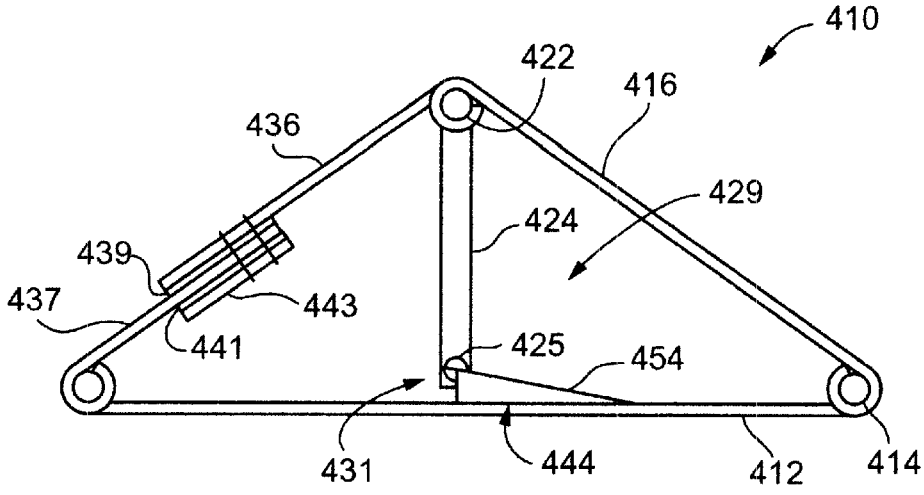
FIG. 24 is a side view of a speed bump according to a fifth preferred form of the present invention, showing the speed bump in a raised, approach position.

FIG. 24 shows the speed bump of the present invention in a fifth preferred form, represented by general reference numeral 410. Similar to the fourth preferred speed bump 310, the speed bump 410 includes a base plate 412, a bottom hinge 414, a front plate 416, a top hinge 422, a first rear plate 436, a second rear plate 437, friction reducing members 439 and 441, an assist plate 443, and a lock mechanism 429. In this form, however, the lock mechanism 429 includes a lock plate 424, a sensor 441 with a sensor rod 425 rotationally coupled to the lock plate 424, and a rider member 444 with a ramp 454 that is engaged by the sensor rod 425.

Figure 25:
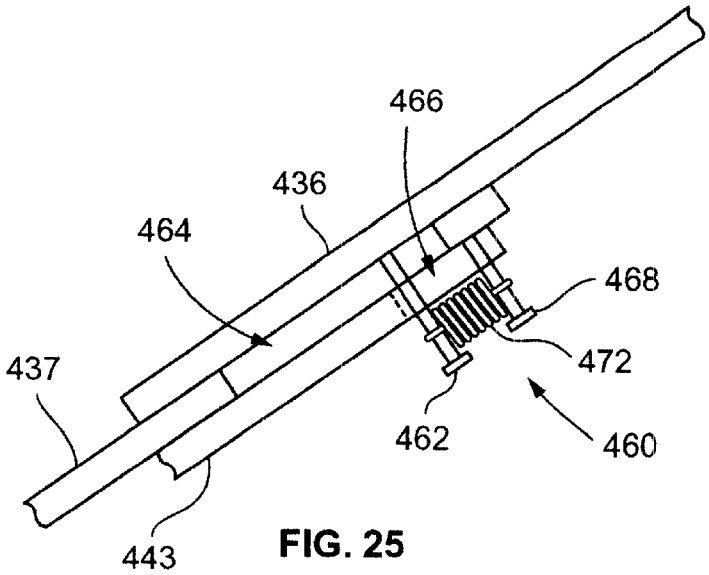
FIG. 25 is a side detail view of a portion of the speed bump of FIG. 24, showing a support spring mechanism when the speed bump is in the raised, approach position.

FIG. 25 shows a support spring mechanism 460 with the speed bump 410 in the approach position. The spring mechanism 460 has a first retainer 462 coupled to the first rear plate 436 and extending through a slot 464 in the second rear plate 437 and a slot 466 in the assist plate 443, and a second retainer 468 coupled to the second rear plate 437 and extending through the slot 466 in the assist plate 443. A spring 472 is coupled to and extends between the first retainer 462 and the second retainer 468, thereby biasing the first rear plate 436 and the second rear plate 437 into the generally upright, approach position. The first and second retainers 462 and 468 can be provided by screws, or by pins, tabs, flanges, or other structures, and the spring can be provided by a tension coil spring or another spring structure. In a typical commercial embodiment, several spring mechanisms 460 are provided, as may be desired.

Figure 26:
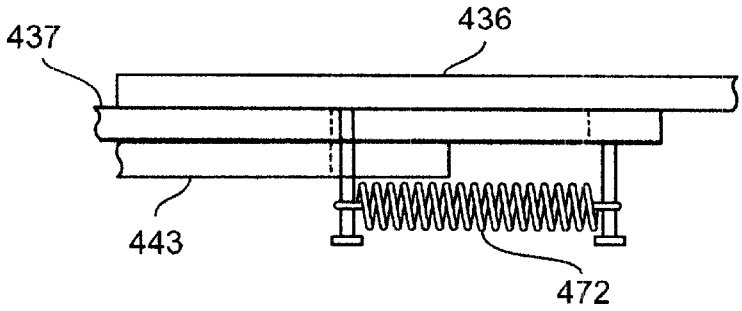
FIG. 26 is a side detail view of the portion of the speed bump of FIG. 25, showing the support spring mechanism when the speed bump is in the collapsed position.

FIG. 26 shows the speed bump 410 in the collapsed position, with the spring 470 extended under tension by the first and second rear plates 437 and 436 moving in opposite directions. The tension in the spring 470 thereby urges the speed bump 410 back to the approach position after being collapsed, without the need for the torsion spring (or other springs) of the previously described embodiments.

Figure 27:
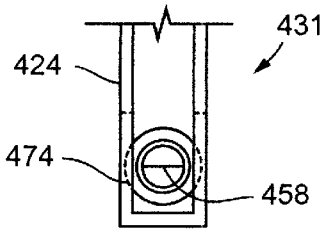
FIG. 27 is a side detail view of a sensor of the speed bump of FIG. 24, showing the sensor when the speed bump is in the collapsed position.
Figure 28:
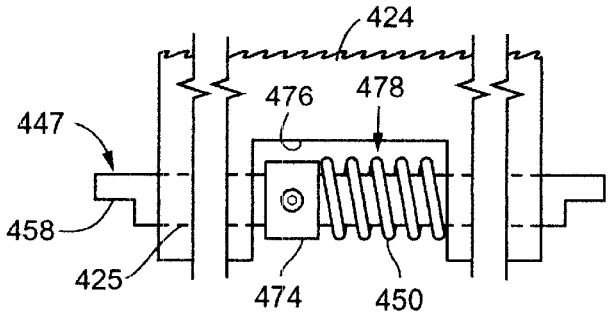
FIG. 28 is a front detail view of the sensor of FIG. 27.

FIGS. 27 and 28 show the sensor 431 rotationally coupled to the lock plate 424 (two generally parallel lock plates can be provided, as shown). The sensor rod 425 is provided a rod, pipe, or other structure, made of a metal or other material. The sensor rod 425 extends from at least one end of the lock plate 424. The sensor rod 425 has at least one extension member 447 with an engagement surface 458 formed thereon for engaging the ramp of the rider member. In a typical commercial embodiment, sensor rod 425 extends the length of and from both ends of the lock plate 424, and two extension members 447 at opposite ends of the sensor rod engage two ramps 454 at opposite ends of the lock plate, with the ramps coupled to the base 412.

The sensor rod 425 is rotationally biased by a sensor spring 450 so that the engagement surface 458 has the desired orientation with the speed bump in raised, the approach position. The sensor spring 450 is provided by a torsion spring or other spring or elastomeric structure. The sensor spring 450 is coupled between the sensor rod 425 and the lock plate 424 by, for example, being connected to a collar 474 on the sensor rod and a side wall 476 forming a notch 476 in the lock plate 424. The collar 474 can be attached to the sensor rod 425 by a set screw or the like. Of course, the sensor spring 450 can be otherwise coupled between the sensor rod and the lock plate. Similar to the above described embodiments, the rates and sizes of the sensor springs 450 are chosen to set the speed bump to operate at a predetermined speed.

Figure 29:
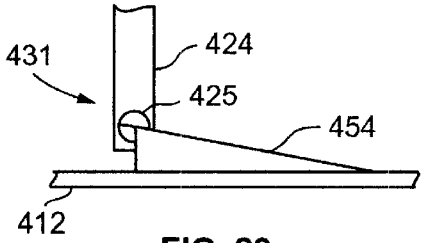
FIG. 29 is a side detail view of the sensor of FIG. 24, showing the sensor with the speed bump in a raised, approach position.
Figure 30:
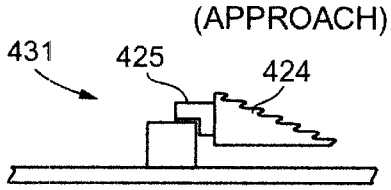
FIG. 30 is a front detail view of the sensor of FIG. 29.
Figure 31:
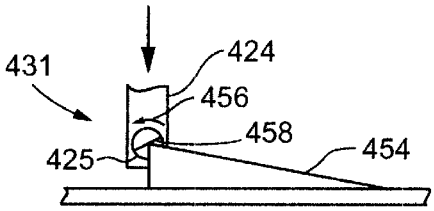
FIG. 31 is a side detail view of the sensor of FIG. 29, showing how the speed bump locks in an inclined position to provide a bump for a vehicle traveling above a predetermined speed as the vehicle passes over the speed bump.
Figure 32:
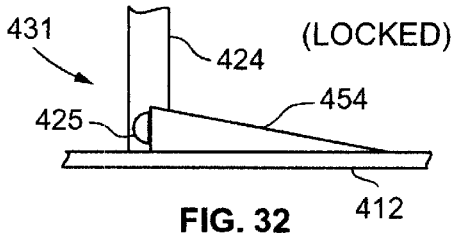
FIG. 32 is a front detail view of the sensor of the speed bump of FIG. 31.

FIGS. 29–34 show the operation of the fifth preferred form of the invention. FIGS. 29 and 30 show the sensor 331 when the speed bump is in the raised, approach position, as a vehicle approaches the speed bump. A wheel of a vehicle contacting the front plate causes the lock plate 434 to be driven downward toward the base plate 412. As shown in FIGS. 31 and 32, when the vehicle exceeds a predetermined speed, the force of the tires impacting on the front plate causes the lock plate 424 to be driven downwardly rapidly enough and with enough force to overcome the resistive force of the sensor spring. Therefore, the force of the engagement surface 458 of the sensor rod 446 on the ramp 454 causes the sensor rod to rotate in a first direction 456. In this manner, the locking plate 324 moves generally downward into contact with the base plate 412, and is thereby locked in an upright, locked position, to discourage drivers from traversing the speed bump at higher than the predetermined speed.

Figure 33:
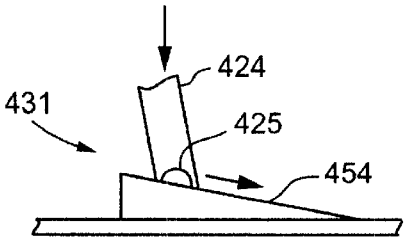
FIG. 33 is a side view of the speed bump of FIG. 29, showing the speed bump collapsing to a horizontal position for a vehicle traveling below a predetermined speed as the vehicle passes over the speed bump.
Figure 34:
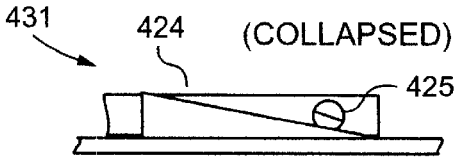
FIG. 34 is a front detail view of the sensor of the speed bump of FIG. 33, showing the speed bump in the fully collapsed position.

However, as shown in FIG. 33, if the vehicle is traveling below the predetermined speed, as determined by the rates and sizes of the sensor spring, then the sensor rod 425 will slide down the ramp 454. Accordingly, the lock plate 424 pivots, thereby permitting the front, lock and rear plates to collapse such that the speed bump 410 becomes essentially horizontal, as shown in FIG. 34. In thus way, the impact of the speed bump is minimized to drivers traveling below the predetermined speed.

The present invention has several advantages not found in the prior art. For example, the invention provides a speed bump that is automatically speed sensitive to collapse to a generally horizontal position to allow vehicles operating below a predetermined speed to drive over the speed bump without a bump. However, the speed sensitive speed bump also locks in a generally upright position to provide a bump for vehicles traveling above the predetermined speed. In this manner, the novel speed bump mechanically discriminates between slower vehicles and faster vehicles, relative to a predetermined speed, and does not provide a frustrating bump to those vehicles that are traveling below the predetermined speed, which do not need to be encouraged to slow down. Furthermore, the speed bump of the present invention is rugged, has few moving parts, and provides an inexpensive way to mechanically provide automatic operation of a speed bump based on the speed of a vehicle going over the speed bump.

While the invention has been disclosed in preferred forms, it will be apparent to those skilled in the art that many modifications, additions, and deletions may be made therein without departing from the spirit and scope of the invention as set forth in the following claims.

What is claimed is:

1. An automatic speed bump for use by a vehicle traveling on a driving surface, the vehicle having at least one tire, the speed bump comprising:

a base mounted to the driving surface;

a front pivot member hingedly coupled to said base;

a first rear pivot member hingedly coupled to said front member and a second rear pivot member hingedly coupled to said base, wherein portions of said first and second rear members overlap;

a support spring that biases said front pivot member toward a raised, approach position; and a speed-sensitive lock mechanism coupled to said front pivot member or said base that locks said front pivot member in said raised position when impacted by a vehicle tire traveling at a speed at or above a predetermined speed.

2. An automatic speed bump as claimed in claim 1 wherein said support spring is coupled between said first and second rear members to bias said speed bump into said raised position.

3. An automatic speed bump for use by a vehicle traveling on a driving surface, the vehicle having at least one tire, the speed bump comprising:

a base mounted to the driving surface;

a front pivot member hingedly coupled to said base;

a support spring that biases said front pivot member toward a raised, approach position; and a speed-sensitive lock mechanism coupled to said front pivot member or said base that locks said front pivot member in said raised position when impacted by a vehicle tire traveling at a speed at or above a predetermined speed; wherein said speed-sensitive lock mechanism comprises a lock member pivotally coupled to said front pivot member and a sensor that is coupled to or that engages said lock member, said sensor including a sensor spring.

4. An automatic speed bump as claimed in claim 3 wherein said sensor comprises a support member that is coupled to said lock member by said sensor spring that biases said support member toward said base, wherein said support member is retractable upon engagement with said base.

5. An automatic speed bump as claimed in claim 4 wherein if the vehicle exceeds said predetermined speed, the force of the tires impacting on said front member causes said retractable support to be driven downwardly rapidly enough and with enough force on said base to retract said retractable support against said sensor spring such that said lower edge of said retractable support engages said base with sufficient frictional force to preclude sliding of said lock member or retractable support upon said base, thereby locking said speed bump in said raised position, and wherein if the vehicle speed is less than the predetermined speed, the lesser force imparted by the tires on said front member causes said lock member to be driven downwardly against the retractable support with a force sufficiently small that said support member is permitted to slide across said base so that said front and lock members collapse to said generally horizontal position.

6. An automatic speed bump as claimed in claim 5 wherein said support member has a beveled lower edge that engages said base.

7. An automatic speed bump as claimed in claim 3 wherein said sensor comprises a rider member with a rotary sensor rod extending therefrom and a ramp extending therefrom, a retractable dowel, and a pin extending from said lock plate and engaging said sensor rod, wherein said sensor spring biases said dowel against said sensor rod to orient said sensor rod in position.

8. An automatic speed bump as claimed in claim 7 wherein said support member has at least one extension member with an engagement surface formed thereon that engages said ramp.

9. An automatic speed bump as claimed in claim 8 wherein if the vehicle exceeds said predetermined speed, the force of the tires impacting on said front member causes said pin to be driven downwardly rapidly enough and with enough force on said engagement surface of said sensor rod extension member to overcome a resistive force of said sensor spring and cause said sensor rod to rotate in a first direction so that said pin is retained in a notch formed at least partially by said rotated sensor rod, thereby securing said locking member in an upright, locked position, and locking said speed bump in said raised position, and wherein if the vehicle speed is less than the predetermined speed, the lesser force imparted by the tires on said front member causes said pin to be driven downwardly against said engagement surface with a force sufficiently small that said pin is permitted to slide down said ramp so that said front and lock members collapse to said generally horizontal position.

10. An automatic speed bump as claimed in claim 3 wherein said sensor comprises at least one ramp mounted to said base and at least one sensor rod extending from said lock member and engaging said ramp, said sensor spring biasing said sensor rod against rotation in a first direction.

11. An automatic speed bump as claimed in claim 10 wherein said sensor rod has at least one extension member with at least one engagement surface formed thereon that engages said ramp.

12. An automatic speed bump as claimed in claim 11 wherein if the vehicle exceeds said predetermined speed, the force of the tires impacting on said front member causes said engagement surface of said sensor rod extension member to be driven downwardly rapidly enough and with enough force on said ramp to overcome a resistive force of said sensor spring and cause said sensor rod to rotate in said first direction thereby permitting said lock member to move generally downward into frictional contact with said base to secure said locking member in an upright, locked position, and locking said speed bump in said raised position, and wherein if the vehicle speed is less than the predetermined speed, the lesser force imparted by the tires on said front member causes said sensor rod to be driven downwardly against said ramp with a force sufficiently small that said sensor rod is permitted to slide down said ramp so that said front and lock members collapse to said generally horizontal position.

13. An automatic speed bump as claimed in claim 3 further comprising at least one rear pivot member hingedly coupled to said front member or said base.

14. An automatic speed bump as claimed in claim 13 further comprising a slide member hingedly connected to a lower end of said rear member, and a guide that constrains the slide member to move substantially parallel to said base.

15. An automatic speed bump as claimed in claim 3 wherein said speed-sensitive lock mechanism permits said front pivot member to collapse to a generally horizontal position when impacted by a vehicle tire traveling at a speed below said predetermined speed.

16. An automatic speed bump for use by a vehicle traveling on a driving surface, the vehicle having at least one tire, the speed bump comprising:

a base mounted to the driving surface;

a front pivot member hingedly coupled to said base;

a first rear pivot member hingedly coupled to said front member;

a second rear pivot member hingedly coupled to said base, wherein portions of said first and second rear members overlap;

a support spring coupled between said first and second rear members to bias said speed bump into said raised, approach position.

a speed-sensitive lock mechanism comprising at least one lock member hingedly coupled to said front pivot member, at least one ramp mounted to said base, at least one rotary sensor rod extending from said lock member and having at least one extension member with at least one engagement surface formed thereon that engages said ramp, and at least one sensor spring biasing said sensor rod against rotation in a first direction, wherein said speed-sensitive lock mechanism locks said front pivot member in said raised position when impacted by a vehicle tire traveling at a speed at or above a predetermined speed but permits said front pivot member to collapse to a generally horizontal position when impacted by a vehicle tire traveling at a speed below said predetermined speed.

17. An automatic speed bump as claimed in claim 16 wherein said base, said front member, said lock member, and said rear member each comprise a plate.

18. An automatic speed bump as claimed in claim 16 wherein if the vehicle exceeds said predetermined speed, the force of the tires impacting on said front member causes said engagement surface of said sensor rod extension member to be driven downwardly rapidly enough and with enough force on said ramp to overcome a resistive force of said sensor spring and cause said sensor rod to rotate in said first direction thereby permitting said lock member to move generally downward into frictional contact with said base to secure said locking member in an upright, locked position, and locking said speed bump in said raised position, and wherein if the vehicle speed is less than the predetermined speed, the lesser force imparted by the tires on said front member causes said sensor rod to be driven downwardly against said ramp with a force sufficiently small that said sensor rod is permitted to slide down said ramp so that said front and lock members collapse to said generally horizontal position.

19. An automatic speed bump as claimed in claim 16 wherein said sensor spring is sized and selected to bias said sensor rod against rotation in said first direction so that when a vehicle contacts said speed bump below said predetermined speed said sensor rod will not rotate in said first direction but when a vehicle contacts said speed bump in excess of said predetermined speed said sensor rod will rotate in said first direction.

20. An automatic speed bump as claimed in claim 16 wherein said sensor spring is coupled to a collar mounted on said sensor rod and to said lock member.

21. An automatic speed bump as claimed in claim 16 wherein support spring is coupled to at least one retainer coupled to said first rear member and extending through a slot in said second rear member.

22. An automatic speed bump as claimed in claim 16 further comprising an assist plate coupled to said first rear member.

* * * * *